United States Patent [19]

Dodd et al.

[11] Patent Number: 4,813,660

[45] Date of Patent: Mar. 21, 1989

[54] MULTIPLE PLANE CORRUGATION-VENTED BOTTOM VACUUM CORRUGATION FEEDER

[75] Inventors: Colin R. Dodd, Pittsford; Thomas C. Iaia, Jr., Rochester; William J. McLaughlin, Fairport, all of N.Y.

[73] Assignee: Xerox Corporation, Stamford, Conn.

[21] Appl. No.: 113,856

[22] Filed: Oct. 29, 1987

[51] Int. Cl.[4] ..... B65H 1/06; B65H 3/12

[52] U.S. Cl. ..... 271/11; 271/20; 271/94; 271/98; 271/105; 271/161; 271/165

[58] Field of Search ..... 271/3.1, 5, 11, 20, 271/35, 90, 94, 98, 99, 105, 161, 165, 188, 276

[56] References Cited

U.S. PATENT DOCUMENTS

| | | | |
|---|---|---|---|
| 2,817,519 | 12/1957 | Beck | 271/94 |
| 3,405,935 | 10/1968 | MacNeill | 271/11 |
| 4,005,794 | 2/1977 | Lundquist | 271/161 |
| 4,305,576 | 12/1981 | Hamlin | 271/11 |
| 4,324,395 | 4/1982 | Silverberg | 271/98 |
| 4,336,929 | 6/1982 | Hanzlik | 271/35 X |
| 4,381,893 | 5/1983 | Silverberg | 355/3 SH |
| 4,411,417 | 10/1983 | Browne | 271/94 |
| 4,418,905 | 12/1983 | Garavuso | 271/98 |
| 4,560,158 | 12/1985 | Wilson | 271/165 |
| 4,595,190 | 6/1986 | Amarakoon | 271/94 |
| 4,660,819 | 4/1987 | Allocco, Jr. et al. | 271/161 X |

*Primary Examiner*—Joseph J. Rolla
*Assistant Examiner*—Edward S. Ammeen
*Attorney, Agent, or Firm*—William A. Henry

[57] ABSTRACT

A bottom vacuum corrugation feeder includes a vacuum chamber with a bi-level support surface that support a plurality of apertured belts. The bi-level support surface has a series of raised members on a portion of its surface that corrugate the bottom sheet of a stack of sheets that are supported on a stacking tray. The stacking tray inclues raised members on its stack support surface that allow the venting of air from an air knife positioned in front of the sheet stack for separating the bottom sheet in the stack from the remainder of the stack. Recesses are included in the stack support surface of the stacking tray in order to reduce vacuum leak around the front edge of the sheet stack.

19 Claims, 2 Drawing Sheets

MULTIPLE PLANE CORRUGATION-VENTED BOTTOM VACUUM CORRUGATION FEEDER

The present invention relates to sheet feeding and more particularly to a vacuum corrugation feeder with improved feeding capability.

With the advent of high speed xerographic copy reproduction machines wherein copies can be produce at a rate in excess of three thousand copies per hour, the need for a document and sheet feeder to, for example, feed documents to the platen of a copier in rapid succession in a reliable and dependable manner in order to utilize the full capabilities of the copier. A number of document handlers are currently available to fill that need. These document handlers must operate flawlessly to virtually eliminate the risk of damaging the original document and generate minimum machine shutdowns due to misfeeds or document multifeeds. It is in the initial separation of the individual documents from the document stack where the greatest number of problems occur.

Since the documents must be handled gently but positively to assure separation without damage through a number of cycles, a number of solutions have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member if it acts upon the printed face can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

Various approaches have been highly successful in answering the above problems, for example U.S. Pat. No. 4,305,576 discloses a typical vacuum separating and feeding system wherein a plurality of friction belts is arranged to run over a vacuum plenum placed at the bottom of a sheet supply tray which has a "U" shaped pocket formed in it. The pocket serves to provide space for the bottom sheet to be captured by the vacuum feed belt assembly, to provide an air seal between the bottom sheet and the edges of the pocket and to provide a high pressure seal between the bottom sheet and the remainder of the stack. This high pressure seal is achieved by supporting a major portion of the stack weight on the edge regions of the pocket. However, this "U" shaped configuration was found to not permit deformation of the sheet in a geometrically developable shape which results in a reduction in the degree of levitation of the sheet stack. The bottom sheet vacuum corrugation feeder in U.S. Pat. No. 4,411,417 answered this problem by including a differently designed stack support tray that has a planar base portion defining a base plane, the front of the base portion having an opening within which the bottom sheet separator is positioned. The tray also includes two sloping planar side wings, one at each side of the opening in the base portion. The sloping planar side wings are angled upward from the base plane and are angled outward from front to rear of the tray and intersect the base plane such that the intersection at the rear of the tray is in the approximate location of the rear corners of a rectangle the size of a sheet to be fed and the intersection of the planar wings and the base plane at the front of the tray is approximately midway between the front corners of a sheet to be fed and the centerline of a sheet to be fed.

Other non-friction retard feeders include U.S. Pat. Nos. 4,324,395; 4,381,893; 4,418,905; 4,560,158; and 4,595,190. All of these patents teach bottom sheet vacuum corrugation feeder trays which are used in combination with vacuum transport devices. Air injection means are provided to inject air between a bottom sheet and the remainder of a stack. A raised portion in the center of a vacuum plenum imparts a W-shape to a sheet when the sheet is pulled down by a vacuum. U.S. Pat No. 4,231,562 teaches a bottom sheet document feeder for use with a copying machine and includes an original holding tray 302 of FIG. 11 that may be provided with sets of ridges 326 and 328 extending the length of the holding tray and parallel to sidewalls 310 and 312. The ridges are employed to prevent stacked copies from shifting or slipping .

Even though the above two document handlers in the U.S. Pat. Nos. 4,305,576 and and 4,411,417 patents have been highly successful, an improvement of the document feeder in U.S. Pat. No. 4,411,417 is still needed to feed sheet stacks of more than 100 sheets without increasing air knife pressure and in order to feed down curled sheets.

Therefore, in accordance with the present invention, a bottom sheet separator-feeder for separating and forwarding sheets seriatim from the bottom of a stack of sheets to be fed is disclosed that comprises a stacking tray having a surface for supporting a stack of sheets to be fed, air knife means positioned opposite the sheet stack and adapted to separate the bottommost sheet in the stack from the remainder of the stack, apertured endless vacuum feed belt means extending through at least the front end of said sheet stacking tray for acquiring and advancing the bottom sheet of the stack, said belt means extending across a vacuum chamber that includes a support plate for supporting said belt means having vacuum ports therein for applying a negative pressure at the back of and through said belt means, said support plate having a plurality of corrugation means extending along a sloped bi-level portion of said support plate, a plurality of ribs positioned on a portion of said support surface of said stacking tray in line with at least a portion of said plurality of corrugation means and extending to the rear of said stacking tray, and recesses positioned in a front portion of said support surface of said stacking tray immediately adjacent opposite sides of said endless vacuum belt means in order to improve the feeding of increased sheet stack heights and curled sheets.

For a better understanding of the invention, reference is made to the following drawings and description.

The invention will now be described by reference to a preferred embodiment of the bottom sheet separator-feeder apparatus.

Figure 1:
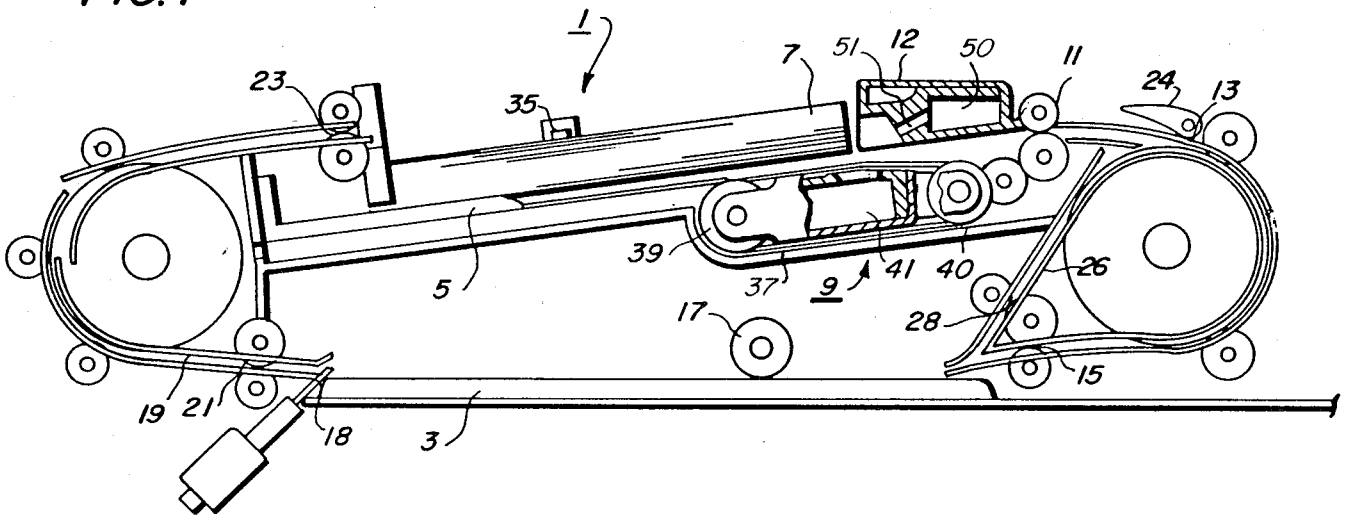
FIG. 1 is a cross sectional side view of an exemplary sheet separator-feeder employing the present invention.

Referring now particularly to FIG. 1, there is illustrated an exemplary automatic sheet separator-feeder for installation over the exposure platen 3 of a conventional xerographic reproduction machine, however, the principle of this invention and document handler 1 could also be used as a copy sheet feeding apparatus with obvious modifications. This is merely one example of a document handler with which the exemplary sheet separator-feeder improvements of the present invention may be combined. The document handler 1 is provided with a document tray 5 which will be described in greater detail later, adapted for supporting a stacked set of documents 7. A vacuum belt corrugating feeding mechanism 9 is located below the front or forward area of the document tray for acquiring and corrugating the bottom document sheet in the stack and for feeding out that document sheet to take-away roll pair 11 through document guides 13 to a feed-roll pair 15 and under platen roll 17 onto the platen of the copy machine for reproduction. A retractable registration edge 18 is provided here to register the lead edge of the document fed onto the platen. Following exposure of the document, the edge 18 is retracted by suitable means such as solenoid and that document is fed off the platen by roll 17 onto guide 19 and feed-roll pair 21 and returned back to the top of the document stack through a feed-roll pair 23. Gross restacking lateral realignment is provided by an edge guide (not shown) resettable to a standard sheet size distance from an opposing fixed edge guide.

In the event it is desired to present the opposite side of a document for exposure, the document is fed from the stack 7 through guides 13 until the trail edge passes document diverter 24. Document diverter 24 is then rotated counterclockwise, i.e., into the document sheet path. The document direction is reversed and the document is diverted by diverter 24 through guides 26 and feed-roll pair 28 onto the platen 3.

The document handler 1 is also provided with a sheet separator finger 35 as is well known in the art, to sense and indicate the documents to be fed versus those documents returned to the document handler, i.e., to count each set circulated. Upon removal (feed out) of the last document from beneath sheet separator finger 35, the finger drops through a slot provided in the tray 5 to actuate a suitable sensor indicating that the last document in the set has been removed from the tray. The finger 35 is then automatically rotated in a clockwise direction or otherwise lifted to again come to rest on top of all the documents in the stack 7, for the start of the next circulation of document set 7.

Figure 2:
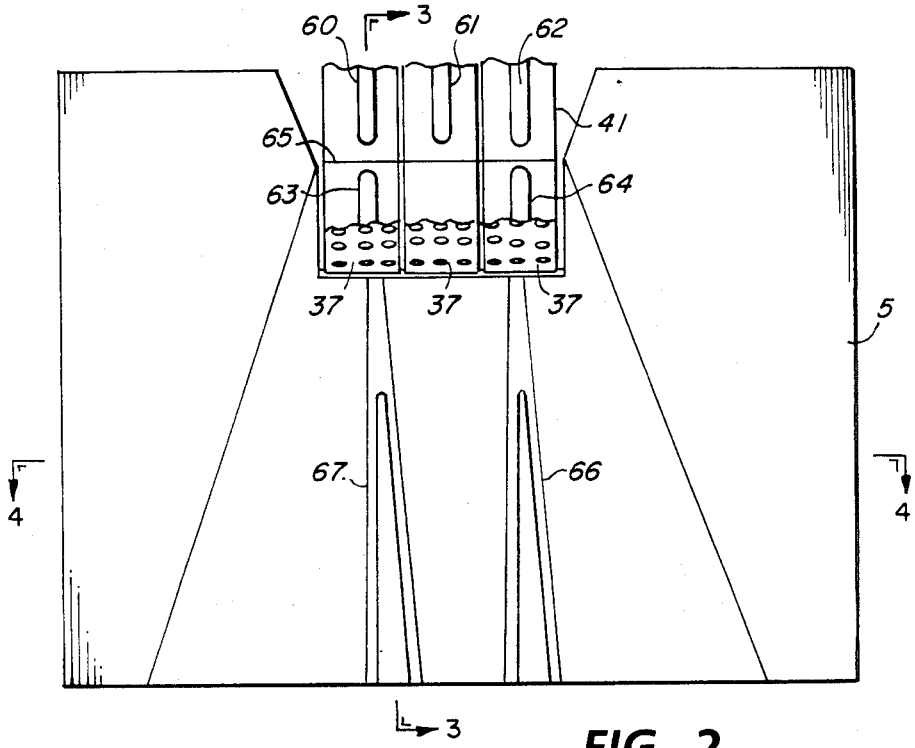
FIG. 2 is a plan view of the sheet separator-feeder showing the sheet stacking tray in accordance with to the present invention.

Referring more particularly to FIG. 2, and the document sheet separator-feeder 9, there is disclosed a plurality of feed belts 37 supported for movement on feed belt rolls 39 and 40. Spaced within the run of the belts 37 there is provided a vacuum plenum 41 having a support plate and openings 43 therein adapted for cooperation with perforations 45 of about 3 mm in the belts 37 to provide a vacuum for pulling the bottom document in the document stack onto the belts 37. The plenum 41 is bi-level sloped and provided with raised portions 60–64 which are illustrated in more detail in FIGS. 2 and 3 that are below the belts 37 so that upon capture of the bottom document in the stack against the belts a corrugation will be developed in the sheet thereby enhancing its separation from the rest of the stack. This increased separation is due to the corrugation gaps placed in the sheet that reduce the vacuum pressure levels between the sheets due to porosity in the first (bottom) sheet and provide for entry of the separating air flow from the air knife 12.

The air knife 12 is comprised of a pressurized air plenum 50 having a plurality of separated air orifices 51 to inject air between the bottommost document pulled down against the feed belts and the documents in the stack thereabove to provide an air cushion or bearing between the stack and the bottom document to minimize the force needed for removing the bottom document from the stack.

By suitable valving and controls, it is also desirable to provide a delay between the time the vacuum is applied to pull the document onto the feed belts and the start up of the feed belts, to assure that the bottom document is captured on the belts before belt movement commences and to allow time for the air knife to separate the bottom sheet from any sheets that were pulled down with it.

Figure 4:
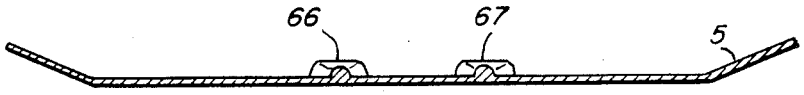
FIG. 4 is an end view of the sheet separator-feeder of FIG. 2 taken along line 4—4.

Turning now to the present invention more particularly, present dragon wing type vacuum corrugation feeders such as in FIG. 4 of U.S. Pat. No. 4,411,417 can suffer from several instabilities leading to both shingled and coincident type multifeeds. The first of these is caused by the lead edge of the feeding sheet (sheet #1) peeling off the transport and fluttering. When this occurs, the sheet will either jam into the air knife front wall and nozzles causing a subsequent failure, or it will "rub" against sheet 2 causing it to shingle forward during the feedout of sheet 1. This failure is resolved in the apparatus of FIG. 1 by the addition of multiple corrugation members in both the front and rear of the sloped bi-level vacuum transport plenum 41. The front of the transport contains three ribs 60–62 that are about 0.7 mm in height and the back portion of the bi-level of the transport contains two ribs or corrugation members 63 and 64 that are about 2 mm in height. The ribs 60–62 extend from the bi-level stabilizer bend line 65 to lead edge of the stack. The three ribs are preferably spaced two inches apart with the center rib falling on the vacuum transport centerline. In addition, the three ribs are parallel to the cover plate portion of transport 41. Rear ribs 63 and 64 are positioned on the vacuum transport plenum extending from the vacuum transport bi-level stabilizer slope bend line 65 toward the rear of the tray. These ribs are in line with the two outboard front ribs only.

Rear ribs 63 and 64 serve several purposes with the primary purpose being further rigidification of document #1 through added corrugation (higher section modulus), as well a providing a vent path both above and below document #1. The vent path below the document allows an alternate air source for any higher pressure leak flow. This minimizes air drawn from around the document lead edge without actually changing the vacuum transport leak flow significantly, thereby reducing any tendency to acquire document #2. The effect of this change is a reduction in the multifeed rate with both reverse shingle and varing width documents. The vent path above document #1 actually provides a channel for air knife flow between document #1 and the stack allowing faster stack levitation and inflation times. This lower impedance flow path for air knife flow reduces losses due to back flow and flow around the lead edge of the stack.

To further reduce leak around the front edge of the stack, the triangular tabs shown in the tray of FIG. 4 of U.S. Pat. No. 4,411,417 as 63 and 64 have been removed and the triangular cut-outs 70 and 71 increased to have about a 16 mm base width which allow the document to conform better to the vacuum transport top plate creating a better seal. The end result is less leak flow around the document lead edge leading to a lower propensity for acquiring document #2 and therefore less multifeeding. The lower leak flow is related to better sealing (higher impedance) and the creation of an alternate lower impedance flow path (for any leak flow which does exist) through the triangular openings. In addition, the triangular shaped recesses virtually eliminates any leak created by a poor relationship between the edge of tray 5 and the cover plate of vacuum transport 41, i.e., the tray will not be above the transport cover plate in this area and therefore cannot prevent the document from sealing.

Figure 3:
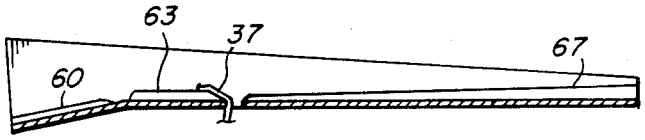
FIG. 3 is a side view of the sheet separator-feeder stacking tray of FIG. 2 taken along line 3—3.

As seen in FIG. 2–4, the two rear vacuum transport corrugation ribs 63 and 64 have in effect been extended all the way through the rear of tray 5 from the edge of the vacuum transport in order to allow the majority of the stack edge venting to occur at the rear edge of the stack as opposed to along the sides of the stack. As a result, flutter of the entire stack due to uneven venting along the edges of the stack is avoided. In essence, the addition of full length ribs 66 and 67 to the document support surface of tray 5 affords improved venting along the rear edge of the stack where the pressures are more uniform and therefore allow a significantly more complete pocket to be formed. In addition, ribs 66 and 67 which have a beginning height of 1.5 mm and a height at the rear of the tray of 2.5 mm allow a lower impedance channel front to rear to form and thereby enhances the acquisition of document #1 since the pocket forms faster than heretofore possible due to this channel. Also, as a result of the addition of ribs 66 and 67 to tray 5, improved feeding of curled sheets is attained due to a better pocket being formed and it has been found that many stacks which previously would multifeed at any pressure (due to the lack of complete pocket formation) now feed at normal stack pressures successfully.

It should be apparent that a separator-feeder apparatus is disclosed that has accomplished an overall increase in efficiency of vacuum corrugation feeders to the extent of a 30–45% reduction in required air knife pressure (from 46 mm W.G. to 28 mm W.G. for 100 sheets of flat 20# or equivalent mass stacks of other weight and from 75 mm to 45 mm W.G. for curled stacks of the same mass). Tests have shown that increased stack height capacity has been attained for stacks of 200–250 sheets of 20# and equivalent mass of others with only 45 mm W.G. of air knife pressure. These improved results have been attained by adding a number of ribs at the front and rear of the vacuum transport cover plate to increase lead edge flutter and stiffen the sheets. Ribs are attached to the sheet support surface of the tray in order to insure venting of air at the rear of the stack and thereby provide stable performance of the air knife and to serve as additional an air source for the vacuum transport thus minimizing air drawn from around the sheet edges. Recessed portions in the front of the sheet support tray are included to reduce leak around the lead edge of the stack to decrease multifeeds.

While the invention has been particularly shown and described with reference to preferred embodiments thereof, it will be understood by those skilled in the art that various changes in form and details may be made therein without departing from the spirit and scope of the invention.

What is claimed is:

1. A bottom sheet separator-feeder for separating and forwarding sheets seriatim from the bottom of a stack of sheets to be fed, comprising: a stacking tray having a surface for supporting a stack of sheets to be fed, air knife means positioned opposite the sheet stack and adapted to separate the bottommost sheet in the stack from the remainder of the stack, apertured endless vacuum feed belt means extending through at least the front end of said sheet stacking tray for acquiring and advancing the bottom sheet of the stack, said belt means extending across a vacuum chamber that includes a bi-level support plate for supporting said belt means having vacuum ports therein for applying a negative pressure at the back of and through said belt means, said support plate having a plurality of corrugation means for corrugating the bottommost sheet in the stack extending along a sloped bi-level portion of said support plate, a plurality of ribs positioned on a portion of said support surface of said stacking tray in line with at least a portion of said plurality of corrugation means and extending to the rear of said stacking tray, and recesses positioned in a front portion of said support surface of said stacking tray immediately adjacent opposite sides of said endless vacuum belt means in order to improve the feeding of increased sheet stack heights and curled sheets.

2. The separator-feeder of claim 1, wherein said corrugation means on said support plate of said vacuum chamber includes three raised members on a first portion of said bi-level portion of said support plate with one of said raised members being positioned in the center of said support plate.

3. The separator-feeder of claim 2, wherein said plurality of ribs positioned on a portion of said support surface of said stacking tray adjacent a rear portion of said support plate are in line with said raised members on said support plate other than said one of said raised members.

4. The separator-feeder of claim 3, wherein said ribs increase in height as they progress from adjacent said rear portion of said support plate toward the rear of said stacking tray.

5. The separator-feeder of claim 4, wherein said raised members have a height of about 0.7 mm.

6. The separator-feeder of claim 2, wherein said support plate includes a pair of raised members positioned on a second portion of said bi-level portion of said support plate and wherein said pair of raised members are aligned with members other than said one of said raised members on said first portion of said bi-level portion of said support plate.

7. The separator-feeder of claim 6, wherein said raised members on said second portion of said bi-level portion of said support plate have a height of about 2 mm.

8. The separator-feeder of claim 4, wherein said plurality of ribs have a beginning height of about 1.5 mm and an ending height of about 2.5 mm.

9. The separator-feeder of claim 8, wherein said endless vacuum belt means includes holes of about 3 mm in diameter.

10. A bottom sheet separator-feeder for separating and forwarding sheets seriatim from the bottom of a stack of sheets to be fed, comprising: a stacking tray having a support surface for supporting a stack of sheets to be fed, air knife means positioned opposite the sheet stack and adapted to separate the bottommost sheet in the stack from the remainder of the stack, apertured endless vacuum feed belt means extending through at least the front end of said sheet stacking tray for acquiring and advancing the bottom sheet of the stack, said belt means extending across a vacuum chamber that includes a bi-level support plate for supporting said belt means having vacuum ports therein for applying a negative pressure at the back of and through said belt means, said support plate having a plurality of corrugation means for corrugating the bottommost sheet in the stack extending along bi-level portions thereof, a plurality of ribs positioned on a rear portion of said support surface of said stacking tray in line with at least two of said corrugation means and adapted to insure venting at the rear of said stacking tray, and triangular shaped recesses positioned in a front portion of said spport surface of said stacking tray immediately adjacent opposite sides of said endless vacuum belt means in order to improve stack height feeding capacity and the feeding of curled sheets.

11. The separator-feeder of claim 10, wherein said corrugation means on said support plate of said vacuum chamber includes three raised members on a first portion of said bi-level portion of said support plate with one of said raised members being positioned in the center of said support plate.

12. The separator-feeder of claim 11, wherein said plurality of ribs positioned on a portion of said support surface of said stacking tray are in line with said raised members other than said one of said raised members.

13. The separator-feeder of claim 12, wherein said plurality of ribs are positioned adjacent a rear portion of said support plate and increase in height as they progress from said rear portion of said support plate toward the rear of said stacking tray.

14. The separator-feeder of claim 13, wherein said raised members have a height of about 0.7 mm.

15. The separator-feeder of claim 14, wherein said support plate includes a pair of raised members positioned on a second portion of said bi-level portion of said support plate and wherein said pair of raised members are aligned with members other than said one of said raised members on said first portion of said bi-level portion of said support plate.

16. The separator-feeder of claim 15, wherein said raised members on said second portion of said bi-level portion of said support plate have a height of about 2 mm.

17. The separator-feeder of claim 13, wherein said plurality of ribs have a beginning height of about 1.5 mm and an ending height of about 2.5 mm.

18. The separator-feeder of claim 17, wherein said endless vacuum belt means includes holes of about 3 mm in diameter.

19. The separator-feeder of claim 10, wherein said triangular shaped recesses have a base portion width of about 16 mm.

* * * * *